US009205473B2

(12) United States Patent
Cernuschi et al.

(10) Patent No.: US 9,205,473 B2
(45) Date of Patent: Dec. 8, 2015

(54) MANDREL CONVEYING DEVICE FOR A TUBE ROLLING MILL

(75) Inventors: Ettore Cernuschi, Castelletto Sopra Ticino (IT); Claudio Maria Scalmana, Milan (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 695 days.

(21) Appl. No.: 13/438,107

(22) Filed: Apr. 3, 2012

(65) Prior Publication Data

US 2013/0008219 A1 Jan. 10, 2013

(30) Foreign Application Priority Data

Jul. 4, 2011 (IT) ..... MI2011A0573

(51) Int. Cl.

| | |
|---|---|
| ***B21B 17/02*** | (2006.01) |
| ***B21B 25/02*** | (2006.01) |
| ***B21B 17/04*** | (2006.01) |
| ***B21C 45/00*** | (2006.01) |

(52) U.S. Cl.

CPC ..... *B21B 25/02* (2013.01); *B21B 17/04* (2013.01); *B21C 45/00* (2013.01)

(58) Field of Classification Search

CPC ..... B21B 17/02; B21B 17/12; B21B 25/02; B21B 39/02; B21B 39/14; B21B 39/16; B21B 17/00; B21B 25/06; B21D 5/143; B21D 3/045; B21C 45/00; B21C 3/16; B21C 5/003; B21C 5/006; B21C 1/32; B21C 1/34

USPC ..... 72/95–98, 208, 209, 370.14, 370.25, 72/110, 370.01, 370.06, 368, 429, 452.2; 74/422, 89.17, 89.18

See application file for complete search history.

(56) References Cited

U.S. PATENT DOCUMENTS

| | | | | | |
|---|---|---|---|---|---|
| 4,037,449 | A | * | 7/1977 | Schuetz | 72/209 |
| 4,186,585 | A | * | 2/1980 | Passoni et al. | 72/208 |
| 4,311,032 | A | * | 1/1982 | Nessi | 72/208 |
| 4,361,023 | A | * | 11/1982 | Blanquet et al. | 72/209 |
| 4,395,897 | A | * | 8/1983 | Blanquet | 72/97 |
| 4,487,047 | A | * | 12/1984 | Killop | 72/88 |
| 4,488,421 | A | * | 12/1984 | Quecchia et al. | 72/208 |
| 5,513,511 | A | * | 5/1996 | Imae et al. | 72/208 |
| 2012/0103049 | A1 | | 5/2012 | Cernuschi et al. | |

FOREIGN PATENT DOCUMENTS

| | | |
|---|---|---|
| GB | 423784 | 2/1935 |
| GB | 2128119 | 4/1984 |
| JP | 59179205 | 10/1984 |
| JP | 1151409 | 6/1989 |

* cited by examiner

*Primary Examiner* — Peter Vo
*Assistant Examiner* — Joshua D Anderson
(74) *Attorney, Agent, or Firm* — Stetina Brunda Garred & Brucker

(57) ABSTRACT

A rolling plant (R) for rolling tubes having a multi-stand rolling mill (5) with two or more rolls, in order to implement a controlled speed mandrel rolling process, comprises a hooking and releasing device (61) which is arranged in the inlet area of the rolling mill (5) to cooperate with the rear tang of the mandrel (31) and a hooking and releasing device (71) which is arranged in the outlet area of the rolling mill (5) to cooperate with the front tang of the mandrel (31) in coordinated manner with the first hooking and releasing device (61).

12 Claims, 12 Drawing Sheets

MANDREL CONVEYING DEVICE FOR A TUBE ROLLING MILL

CROSS-REFERENCE TO RELATED APPLICATIONS

STATEMENT RE: FEDERALLY SPONSORED RESEARCH/DEVELOPMENT

BACKGROUND

1. Field of the Invention

The present invention relates to a mandrel conveying device for a multi-stand continuous tube rolling mill operating with a mandrel.

2. State of the Art

Longitudinal multi-stand rolling mills of the prior art, operating with mandrel, may be grouped conventionally into various types, according to their architecture, with particular regards to the rolling speed control and to the speed and position of the mandrel within the tube.

Continuous floating (i.e. free) mandrel rolling mills are those in which the mandrel can move freely inside the tube during the rolling passage through the multi-stand rolling mill according to the friction forces which are generated between mandrel and inner wall of the tube. The mandrel thus gradually accelerates as the rolling stands bite in sequence. The mandrel is removed from the tube at the end of the rolling operation off the rolling line, or in all cases when the tail of the tube has exited from the last rolling stand, and thus when the free mandrel has assumed the same advancement speed as the tube. Very short cycle times, and thus high productivity, are obtained, e.g. up to a production of 4-5 pieces per minute, with this type of rolling mills.

On the other hand, this type of rolling mill is subject to various drawbacks. The acceleration of the mandrel causes compression states in the tube which are detrimental to the dimensional quality and tubes faultiness because the groove delimited by the rolls is overfilled in the first stands and underfilled in the finishing stands at the end of the rolling mill. Problems of rolling stability and of products with excessive tolerances are thus found. Furthermore, the tube cooling is not uniform along the entire length of the tube because the head part of the tube where the mandrel no longer reaches, immediately after the first step of rolling, remains hot for a longer time, while the part behind, in which the mandrel is still inserted while rolling proceeds, is partially cooled by the mandrel itself with which it is in contact. In these rolling mills, it is normally necessary to provide a downstream heating oven to uniform the tube temperature before the final rolling for calibrating or further reducing the tube diameter.

A second type of rolling mill is that known as semi-floating mandrel rolling mill, in which the mandrel is withheld and advanced, slower than the tube, at the technologically favourable speed during rolling. At the end of the rolling operation, after the tail of the tube has left the last rolling stand, the mandrel is released from the retaining device while remaining within the tube itself and following it while it is moved away from the rolling line. The mandrel is removed from the tube off the rolling line, or however when the tail of the tube has exited from the last rolling stand, and thus when the free mandrel has assumed the same advancement speed as the tube. Short cycle times, and consequently high productivity rates, are obtained in rolling mills of this type, for example: 3-4 tubes per minute. On the contrary, equivalent drawbacks to those of rolling mills of the previous type are found with regards to lack of temperature uniformity along the tube.

A third type of rolling mill is called retained mandrel rolling mill and is characterized by the presence of a rack and pinion mandrel retaining device. At the end of a tube rolling operation, when the tail of the tube leaves the last stand of the rolling mill, the tube has already been previously engaged by its head portion downstream of the rolling mill by means of an extractor device, which grips onto the outer surface of the tube. The extractor device, which is generally made in the form of a particular sequence of roll rolling stands, drags the tube forwards in the same rolling direction, while the retaining system locks the mandrel to make it run inside the tube, and pulls it backwards towards the inlet side of the rolling mill from where it is then unloaded and reintroduced in the classic mandrel conveying cycle. The extractor device or mill also has the function of reducing the outer diameter of the tube by rolling it further without mandrel inside while it is removed. The cycle times of this type of rolling mill are longer, and thus productivity is lower than the previously described types: 2 tubes per minute can generally be rolled.

In traditional rolling in retained mandrel plants, the mandrel advances during the step of rolling at controlled speed, also called retaining speed, directed in the same direction of motion as the tube from the inlet to the outlet of the multi-stand rolling mill during the entire rolling cycle.

In rolling processes implemented using this type of rolling plant, the mandrel is normally inserted into the pierced shell at the beginning of each rolling cycle, starting from the tail in direction of the head of the pierced shell itself, with motion in the same sense as the direction of rolling of the tube.

This first operation may occur in line with the rolling axis, and this is known as in-line insertion, or off line, and this case is known as pre-insertion, the pre-insertion of the mandrel in the pierced shell being used to reduce the travel of the mandrel retaining devices, and thus to reduce the cycle time of the rolling mill itself, increasing productivity. A limitation of this technology is thus its low productivity, in particular for rolling mills used for rolling small and medium sized tubes, e.g. those which have a nominal diameter smaller than or equal to 7" (177.8 mm).

Another type of rolling mill is the one named retained mandrel type with extractor and tube release at the end of rolling, with passage of the mandrel through the extractor. The rolling process carried out in this type of rolling mill includes that, at the end of the tube rolling operation, the mandrel is immobilized in the specific retaining device, while the tube is removed from the mandrel by means of the extractor device by pulling it along the rolling line. After the tube has passed all through the extractor device, the mandrel is then released from the retaining device, conveyed forward by pressing rolls along the rolling line and is passed through the extractor device immediately after the tube and is finally unloaded downstream of the extractor itself to follow the circuit provided for the mandrel reuse. Relatively short cycle times are obtained in these rolling mills: 2.5 tubes per minute.

A disadvantage of the latter type of plant is that the process includes conveying the still very hot mandrel by means of pressing rolls with the risk of damaging the mandrel surface. In this type of process, the mandrel retaining device during the step of rolling, normally of the rack type, must include a releasing device which works in cycle and is adapted to release the mandrel itself after removing the tube.

In order to implement the rolling process in a rolling plant with retained mandrel, the passage of the mandrel through the extractor mill requires the latter to be made with a stand which can open and close quickly to allow the passage of the rolled tube first and then the mandrel at each rolling cycle, given the high speeds at which pierced shells, tubes and mandrels move along the rolling line. If the operating accuracy of the extractor device is not guaranteed there may be the risk of misalignment of the edges of two adjacent rolls with the consequent longitudinal marking of the rolled tube.

The processes with retained mandrel type rolling plants are in all cases advantageous with regards to tube quality which can be obtained and the thermal conditions in which the tube leaves the rolling mill; indeed only in this type of rolling mill it is possible to include the calibration of the final diameter of the tube also without intermediate heating.

In order to guarantee also an efficient rolling process, either of the retained or semi-floating mandrel type, it is important to use a mandrel retaining device which guarantees mandrel speed stability during the rolling cycle, is robust and offers the possibility of hooking and releasing the mandrel itself, said possibility not being offered by a chain and sprocket system, the latter being very common today. Indeed, in the case of rolling plant with semi-floating or retained mandrel, a retaining device with chain wrapped on sprockets and provided with hooking carriers is disadvantageous due to the premature wear of its components, the noise and the elongation that the chain undergoes over time. In order to avoid such drawbacks of the chain system, in-cycle hooking and releasing systems are used in some known plants of the controlled speed retained mandrel type to implement short cycle time rolling methods. In all cases, these systems do not work centred with the mandrel traction axis, and thus add problems related to flexion loads acting on the hooking/releasing systems.

A rolling mill and retained mandrel rolling process thereof is disclosed in document WO2011/000819, in which, after extracting the tube while the mandrel is still retained and the tube is conveyed and rolled through the extractor device without the mandrel being inside any longer, the mandrel is evacuated from the rolling line downstream of the rolling mill and laterally with respect to the rolling line.

In the known retained mandrel plants, described above, it is however difficult to make short tubes because the latter are shorter than the distance between the axis of the last stand of the multi-stand rolling mill and the first stand of the extractor.

The market requires rolling plants which allow greater final product flexibility, i.e. which are capable of rolling tubes of different lengths, with replacement operations concerning a minimum number of plant components, which allow to reduce the rolling cycle time of the tubes and to increase the global productivity of the plant, which increase the finished tube quality or which at least do not penalise it, which have a more rational structure of the plant itself, reducing manufacturing and management costs of the plant.

BRIEF SUMMARY

It is a primary object of the present invention to make a mandrel conveying device for a tube rolling plant, with continuous multi-stand rolling mill operating with a mandrel, which is more cost-effective to make and to operate, guaranteeing a high productivity of the rolling process.

A further object of the invention is to make a mandrel conveying device for a tube rolling plant of the retained or semi-floating mandrel type which allows an accurate control of the mandrel speed during the rolling operations and which works in centred manner with respect to the traction exerted on the mandrel by the tube being rolled.

These objects are reached, in accordance with a first aspect of the invention, by means of a mandrel conveying device for a multi-stand tube rolling mill with mandrel, defining a rolling axis, comprising a rack device and a hooking and releasing device for hooking and for releasing a tang of the mandrel, wherein the rack device comprises two racks side-by-side, parallel to the rolling axis, each of said two racks has two respective gear teeth and two respective ends, the hooking and releasing device being arranged at one end of the two racks.

The mandrel conveying device of the invention is adapted for all retained or semi-floating mandrel type rolling plants, of the types of the prior art described above. Advantageously, the mandrel conveying device is particularly adapted for a controlled speed, retained mandrel tube rolling plant with which a high productivity rolling process is carried out in which the mandrel used in each rolling cycle is inserted in the pierced shell in line, but proceeding backwards through the multi-stand rolling mill, reversely to that which is normally carried out in retained mandrel rolling mills, i.e. in the direction opposite to the rolling direction, entering first with the tail end from the last stand of the rolling mill.

By virtue of this configuration of the rolling plant, a further advantage is reached because it is possible to also eliminate the extractor device or mill from the rolling plant, while preserving the advantages of using a retained mandrel rolling process of known type. A further advantage of the plant of the invention is the possibility of rolling tubes of various length, in particular tubes also shorter than those commonly produced, i.e. longer than approximately 8-10 m at the multi-stand rolling mill outlet. An advantage which derives from not using an extractor mill at the end of the rolling line is that of obtaining tubes with thinner walls. Indeed, when there is an extractor mill in a retained mandrel rolling mill, as normally in the case of the prior art, the possibility of rolling thin tubes, i.e. tubes with a high diameter/thickness ratio, is reduced. This is due to the fact that an extractor mill normally performs a further rolling function which produces a 3%-5% reduction of the outer diameter of the tube and, in absence of the mandrel inside, this operation implies a thickening of the tube wall of 1.5%-2.5%. Essentially, there would be a reduction of the ratio between outer tube diameter and the thickness of the same by an amount equal to 4.5%-7.5%. This is avoided by virtue of the rolling plant of the invention.

Being the mandrel conveying device optimal for performing a retained mandrel rolling process, it allows to exploit the advantages of this type of rolling mill. For example, by using the plant mentioned above it is possible to reduce the final diameter of the tubes avoiding an intermediate heating between the rolling stages on mandrel and the final diameter reduction stage, which in retained mandrel rolling mills of the prior art is normally carried out on a rolling mill of the calibrator or stretching reducer type.

In brief, an optimal, but not exclusive use of the mandrel conveying device of the invention is in a rolling plant in which the rolling process requires the mandrel to be used in a particular rolling cycle is loaded in the area downstream of the rolling mill, then inserted backwards into the multi-stand rolling mill by means of a mandrel conveyor, being the conveyor arranged downstream of the multi-stand rolling mill. The pierced shell which must be rolled in that cycle with that particular mandrel is loaded by translating it transversally to the rolling direction and arranged on the rolling axis at the multi-stand rolling mill inlet. The insertion of the mandrel continues, exiting from the first stand of the multi-stand rolling mill, backwards into the pierced shell and finally the rear end of the mandrel is hooked onto a mandrel conveyor arranged on the inlet side of the multi-stand rolling mill in the moment in which the tail area of the mandrel peeks out from the tail of the pierced shell. In order to allow the hooking by the mandrel conveyor, the rear end of the mandrel is provided with a specific tang prepared for hooking. At this point, the mandrel of that rolling cycle is positioned coherently to the features of the pierced shell used and the tube to be produced. Subsequently, the pierced shell is pushed into the multi-stand rolling mill by means of motorized feeding rolls, while the mandrel proceeds backwards at controlled rolling speed.

The control system (of known type) of the rolling plant includes rolling the last part of the tube (i.e. the tail or rear portion) in the last stand in which the thickness of the tube wall is rolled, when the head of the mandrel is just upstream of the stand itself, thus avoiding the use of a subsequently extractor mill to remove the rolled tube from the mandrel. Such a point is conventionally known as meeting point between mandrel and rolled tube.

Subsequently, again during the same rolling cycle, the tube moves towards the outlet of the multi-stand rolling mill, while the mandrel proceeds its motion, again in direction opposite to the direction of rolling, towards the rolling mill inlet area. By virtue of this insertion kinematics of the mandrel inside the pierced shell and of the relative motion between mandrel and tube, the time in which the already rolled tube is superimposed over the mandrel held in its inner cavity is reduced. In this manner, the cooling of the tube itself caused by the contact with the body of the mandrel, which has a temperature lower than that of the tube, is reduced, thus facilitating its possible subsequent rolling by reduction of the outer diameter without necessarily proceeding with intermediate heating.

The tube, once the mandrel has been pulled out from the inside of the tube, is stopped downstream of the multi-stand rolling mill in position entirely clear from the encumbrance of the rolling mill, while the mandrel used in that rolling cycle is stopped in the inlet area of the rolling mill itself in a position in which the tip of the mandrel is arranged all out from the rolling stands and totally free from the encumbrance of the rolling mill.

At this point, on the inlet side, the mandrel used in that rolling cycle which has just been completed is evacuated from a side of rolling axis to an off-line position so as to clear the rolling axis. The determined rolling cycle is thus concluded and at the same time, or immediately afterwards, the next pierced shell is loaded from off-line to the rolling axis to start the next rolling cycle, which is carried out with the same sequence.

Such evacuation operations of the mandrel from the line in the inlet area and insertion operations of the next pierced shell on the line may be carried out in various manners, e.g. by using two rotating arms operating in coordinated manner.

On the outlet side of the multi-stand rolling mill, the tube rolled in the rolling cycle which has just been completed is in immovable position, reached after braking made by means of braking means of the known type, and is evacuated from the rolling axis to an off-line position by means of various systems, e.g. by means of a rotating arm. The mandrel which must be used for rolling in the subsequent cycle is inserted from an off-line position onto the rolling axis also, for example, by means of rotating arms. The motion of these two rotating arms is coordinated in order to reduce the cycle times.

In this cycle, similarly to all previous cycles of the process, the new mandrel is inserted backwards in the rolling mill reproducing all stages of the operation already described for the previous cycle.

A quick, accurate and coordinated execution in optimal manner of the mandrel hooking and releasing operations at each rolling cycle is guaranteed by virtue of the particular features of the hooking and releasing devices incorporated in the two mandrel conveying devices in the inlet area and in the outlet area of the rolling mill, respectively.

By using the mandrel conveying device of the invention in restrained or semi-floating mandrel rolling plants, a high productivity of the rolling plant is guaranteed due to the execution speed of the hooking and releasing operations. Furthermore, the use of a vertical actuating system of the mandrel/pierced shell support rolls is avoided in order to make room for the head of the rack which normally, in the rolling plants of known type, has an encumbrance under the rolling axis which interferes with the mandrel/pierced shell support rolls.

The dependent claims refer to preferred embodiments of the invention.

BRIEF DESCRIPTION OF THE DRAWINGS

Further features and advantages of the present invention will be apparent in the light of the detailed description of preferred, but not exclusive, embodiments of a tube rolling plant according to the invention illustrated by way of non-limitative example, with reference to the accompanying drawings, in which.

Equal reference numbers in the various figures correspond to the same elements or components.

DETAILED DESCRIPTION

Figure 1:
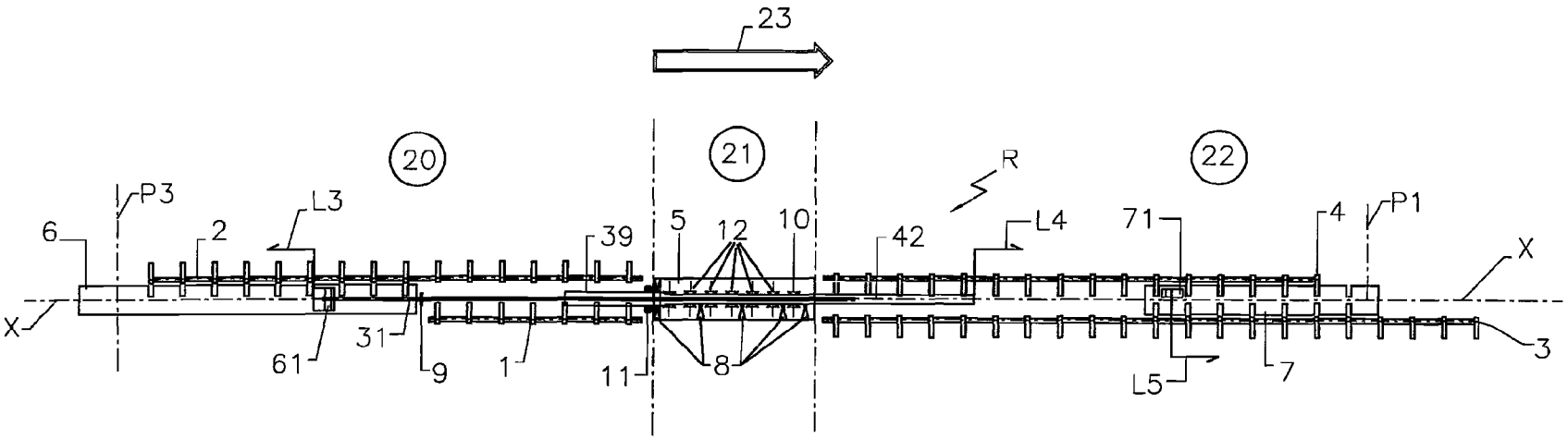
FIG. 1 diagrammatically shows a plan view of a line portion of the tube rolling plant of the invention, in a defined stage of any cycle of the tube rolling process, FIG. 2 diagrammatically shows a plan view of a component of the plant in FIG. 1, FIG. 3 diagrammatically shows a side view of the component in FIG. 2.

The figures show a preferred embodiment of a rolling plant, according to the invention, indicated globally by reference R, operating with a controlled speed mandrel, which may implement a continuous, controlled speed, high productivity mandrel tube rolling process comprising the conveying device of the invention. The rolling plant R defines a rolling axis X and a rolling direction 23 followed by the material to be rolled, commonly named pierced shell 39, and by the rolled tube 42. The plant R is conventionally split into an inlet area or side 20, in which the mandrel unloading device 2 for unloading the mandrel from rolling axis X and the pierced shell loading device 1 for loading the pierced shell on the rolling axis X are located, into a rolling area 21 proper, in which the multi-stand rolling mill 5 is located, and into an outlet area or side 22, in which the mandrel loading device 4 and the rolled tube unloading device 3 from the rolling axis X are located.

The loading device 1 of the pierced shell 39 along the rolling axis X is positioned at the inlet of the multi-stand rolling mill 5 and is advantageously, but not exclusively, made in the form of a rotating arm fitted by the side of the rolling axis X. Such a pierced shell loading device 1, in operation, takes the pierced shell 39 from a side position off the rolling line and deposits it along the rolling axis X on which support rolls of the pierced shell and the mandrel are arranged, but not shown in detail in the figures as being known in the prior art.

The unloading device 2 of the mandrel 31 from rolling axis X is also positioned at the inlet of the multi-stand rolling mill 5 and is advantageously, but not exclusively, made in the form of a rotating arm fitted by the side of the rolling axis X. The unloading device 2 of the mandrel 31 is fitted at the inlet of the multi-stand rolling mill 5 on the side opposite to that of the pierced shell loading device 1 with respect to rolling axis X.

The device 2, in operation, takes the mandrel 31 which was used for rolling the tube 42, at the end of each rolling cycle from rolling axis X itself, and carries it to a side position off the rolling line. This position belongs to a recirculation device of the mandrels used in the process, which includes, in known manner and thus not shown in detail in the figures, cooling operations of the mandrel, the temperature of which has increased by effect of the heat received from the tube during the rolling cycle, and lubrication operations before being conveyed to the outlet side 22 of the rolling mill for use in other subsequent rolling cycles.

The unloading device 3 of the rolled tube 42 from rolling axis X is positioned at the outlet of the multi-stand rolling mill 5 and is advantageously, but not exclusively, made in the form of a rotating arm mounted by the side of rolling axis X, which takes the tube 42 at the end of rolling and conveys it to a side position off the rolling axis itself, for possible storage or for other processes or operations. This unloading device 3 from the rolling axis X is fitted at the multi-stand rolling mill outlet on the same side as the pierced shell loading device 1, shown in the lower part of FIG. 1 with respect to rolling axis X.

The mandrel loading device 4 along rolling axis X is positioned at the outlet of the multi-stand rolling mill 5 and is advantageously, but not exclusively, made in the form of a rotating arm fitted by the side of the rolling axis X. In operation, the device 4 takes the mandrel 31 from a side off line position and deposits it along rolling axis X where mandrel and tube supporting rolls and belonging to the mandrel conveyor 7 on outlet side 22 are arranged (also not shown in detail because belonging to the prior art). The mandrel loading device 4 is fitted at the outlet of the multi-stand rolling mill 5 on the same side as the mandrel unloading device 2, shown in the upper part of FIG. 1 with reference to rolling axis X.

The multi-stand rolling mill 5 is advantageously, but not exclusively, used as rolling mill of the alternating stand type with two or more rolls per stand, in which the stands are arranged in sequence so that the roll gaps of the odd stands, along the rolling axis X, correspond to the groove bottoms of the even stands, and vice versa. The rolling plant of the invention may also comprise tube rolling mills of other type without departing from the spirit of the invention.

The mandrel conveyor 6 on the inlet side 20 comprises a mandrel supporting device with height-adjustable rolls 92 and a longitudinal mandrel actuation component 62 comprising two racks 62' and 62", parallel to each other (not shown in FIG. 1). A rigid connection 62'" is provided between the two parallel racks so that the three components 62', 62" and 62'" form a single body, and thus a more robust body, between the distal end of the gripping area of the mandrel 31 and for a determined length of the two racks 62' and 62". Each rack 62' and 62" has two respective gear teeth 51, 51' and 52, 52' which are counterpoised, arranged over and under the rolling axis X and parallel thereto. The four gear teeth 51, 51', 52, 52' are thus arranged symmetrically with respect to the axis of the mandrel 31, coinciding with the rolling axis X, so that the axial load produced by the operations correlated to the rolling acting on the mandrel is relieved uniformly on the four gear teeth and on the pinions 55, 55', 56, 56' which engage them. The particular compact structure of the component 62 allows to apply very high axial loads on the mandrel during rolling, without the risk of bending.

The pinions 55, 55', 56, 56', which apply the forces needed and transmit motion to the component 62, are arranged in the pinion box 57, consisting of a supporting structure of shafts provided with toothed wheels, and needing to engage the two racks 62', 62" arranged symmetrically with respect to the rolling axis X; the toothed wheels of the pinions 55, 55', 56, 56' are advantageously fitted over and under the racks themselves. Advantageously, for constructive reasons, the toothed wheels of the pinions 55, 55' which engaged the two gear teeth of the rack 62' are kinematically separately from the toothed wheels of the pinions 56, 56' which engage the two gear teeth 52, 52' of the rack 62".

The pinions 55, 55', 56, 56' are connected in known manner to the respective drive 58 which comprises one or two reducers and a number of motors corresponding to the number of toothed wheels in the pinion box. Advantageously, the shafts exiting from the pinion box 57 are all directed on the same side. The motors are thus all on the same side with respect to the rolling axis X.

Each of the two racks 62' and 62", in the space in which the rigid connection 62'" is not provided, has two inner wheels 53', 54' and two outer wheels 53, 54, while at the mandrel holder head area 68, 69 and in the rear area of the system 62 the wheels 59', 59" are fitted only outside the two heads 68, 69. The wheels 59', 59" run on rails or guides 47.

The arrangement of the wheels may be different from that shown in the figures, i.e. by offsetting the wheels along the direction of X, or by arranging inner wheels also in the area in which the connection 62'" is present, e.g. locally interrupting it.

An alternative to the use of the wheels is constituted by sliding runners fitted on the racks and sliding along rails or guides.

Figure 6:
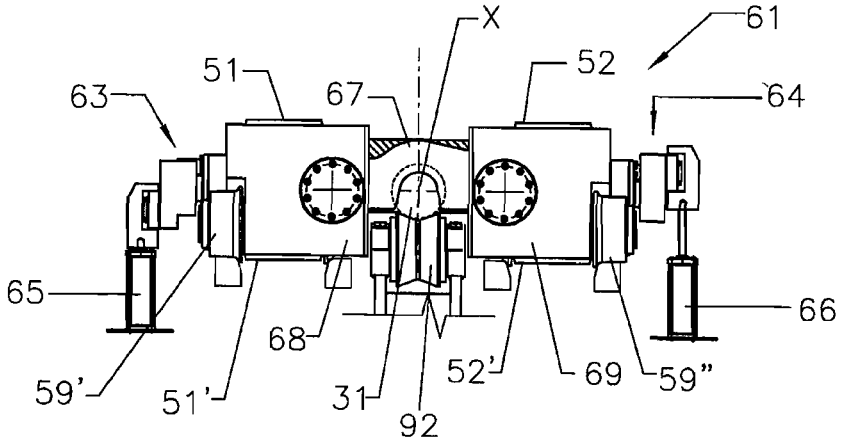
FIG. 6 shows a front view of the detail in FIG. 5.
Figure 7:
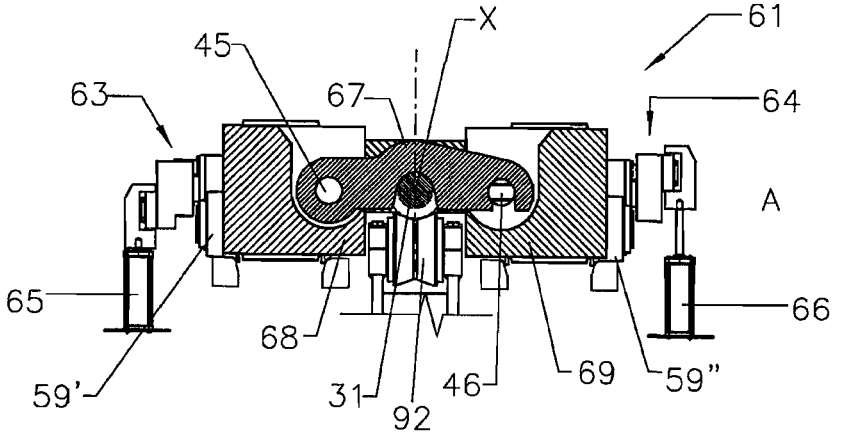
FIG. 7 shows a section view taken along plane A-A of the detail in FIG. 5.
Figure 8:
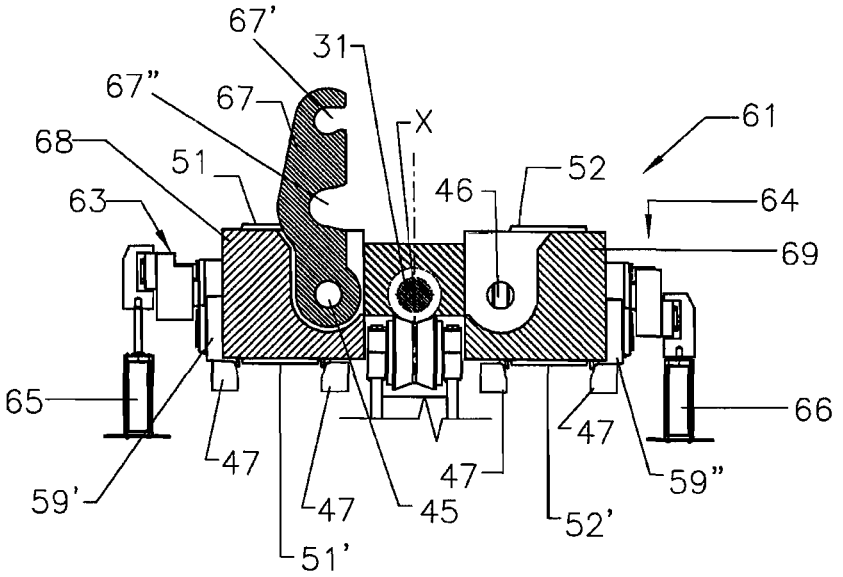
FIG. 8 shows a section view taken along plane A-A of the detail in FIG. 5 in a different operating position, FIG. 9 diagrammatically shows a plan view of another component of the plant in FIG. 1, FIG. 9*a* diagrammatically shows a plan view of a variant of the component in FIG. 9, FIG. 10 diagrammatically shows a side view of the component in FIG. 9.

The mandrel conveyor 6 is also provided with a hooking and releasing device 61 by means of which a first tang, provided in the rear area of the mandrels used in the rolling process, is engaged. The hooking and releasing device 61 is of the so-called "drawbridge" type and acts in connection with the rear tang of the mandrel 31. The closed position of the drawbridge is shown in FIGS. 6 and 7, while the open position is shown in FIG. 8.

The device 61 comprises two heads 68, 69, separate and integrally fixed to the front end of the rack 62' and of the rack 62" respectively; a lever 67, hinged to the first head 68, constituting the so-called drawbridge which is engaged with the other end in a recess arranged in the second head 69 and with the upper part of the rear tang of the mandrel, such a lever 67 being shaped in the central part thereof with an upside-down U-shaped groove 67" complementary with the shape of the rear tang of the mandrel. It is also possible to arrange the elements of the device 61 so as to have the fulcrum of the lever 67 incorporated in the head 69 with the same functions and reverse sense of rotation with respect to the previous variant.

The hooking and releasing device 61 also comprises a control device 63 for controlling the rapid opening and closing of the lever 67 at each rolling cycle. The control device 63 is controlled in turn by a moveable cam 65, or by an equivalent actuation device. The control device 63 is fitted on the head 68 and consists of a kinematic chain which comprises a supporting pin 45 of the lever 67 hinged onto the head 68 itself, respective supports, a conical gear for 90° transfer of rotation motion. Further there are provided a shaft and a control lever 63', preferably with wheel, the necessary supports of the shaft, a bistable system 89, preferably of the extensible rod type with spring, to maintain the control lever 63' in two alternating lowered and raised positions corresponding two positions of locked mandrel and unlocked mandrel. The lever 67 passes from a hooking position to a releasing position by means of an anticlockwise rotation, as shown in figures from 6 to 8. The passage from releasing to hooking occurs by clockwise rotation, instead.

A locking device 64 of the lever 67 in closed position is advantageously present and controlled by a respective moveable cam device 66, or other equivalent actuating device. The locking device 64 in lowered position of the lever 67 is incorporated on the head 69. The locking device 64 consists in a kinematic chain comprising a locking pin 46 of the lever 67 integral with the head 69, respective supports, conical gear for 90° transfer of the motion, shaft and control lever 64' preferably with wheel, the necessary shaft supports. A locking pin 46 is engaged with an appropriately shaped recess 67', made on the lever 67. The control 64 acts on the pin 46, preferably in rotational manner, so that the pin 46 turns from a releasing position from the respective shaped recess 67' to an interference position with the shaped recess 67'. This locking device 64 also includes the use of a bistable system 89', but similar to the system 89 incorporated in the head 68, adapted to maintain the control lever 64' in two alternative positions corresponding to the locking of the lowered drawbridge 67 and the releasing of the drawbridge 67 to allow the rotation thereof to the open position.

The two cams 65, 66, or actuation devices, positioned at predetermined positions along the rolling line and fixed with respect to the sliding direction of the racks 62', 62", can cause a motion in vertical direction corresponding to an angular displacement of the respective control lever 63' and 64' when the hooking and releasing device 61 arrives at them.

At least two cams 65 and 66 or actuation devices are fitted at each of the points in which the hooking and unhooking of the rear tang of the mandrel 31 is designed. If the rolling plant R also includes an emergency guillotine 9, a further device may be provided to release the mandrel in emergency position.

This advantageous configuration of the mandrel conveying device 6 allows a simplification of the mandrel supporting device, constituted by rolls the axis of which is moveable in vertical direction, one of which diagrammatically indicated by numeral 92 is shown in the figures. Indeed, during the motion of the hooking device 61 it is not necessary to lower the rolls 92 into a space equal to the height of the encumbrance of the heads 68 and 69 because the rolls may pass in the space provided between the two heads 68 and 69.

The mandrel conveyor 7 on outlet side 22 in a first embodiment comprises a supporting device of the mandrel consisting of height adjustable rolls and a longitudinal actuating system of the mandrel, not shown in FIG. 1, being of known type. The conveyor 7 further comprises a rack 72 and a drawbridge hooking and releasing device 71 similar to the one described above, illustrated in greater detail in Figures from 9 to 15. The rack 72 incorporates two gear teeth 78, 78', which are counterpoised and arranged over and under the rolling axis X. The rack is provided with wheels 84, 84' for facilitating the axial sliding. An alternative to the use of the wheels for the rack 72 is constituted by sliding runners integral to the racks 72 and sliding along rails or guides.

Figure 13:
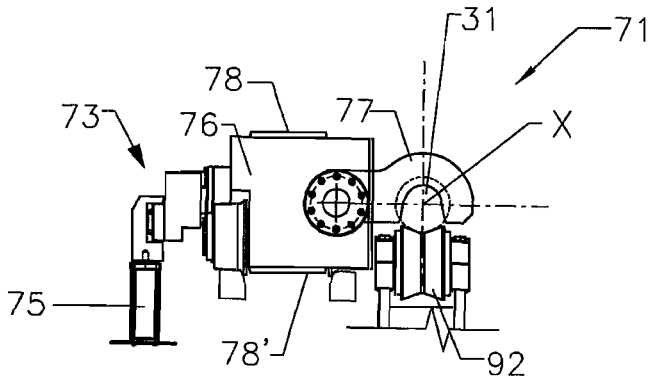
FIG. 13 shows a front view of the detail in FIG. 12.
Figure 14:
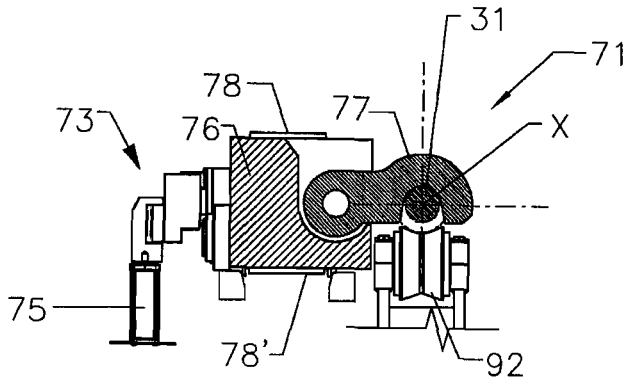
FIG. 14 shows a section view taken along plane A-A of the detail in FIG. 12.
Figure 15:
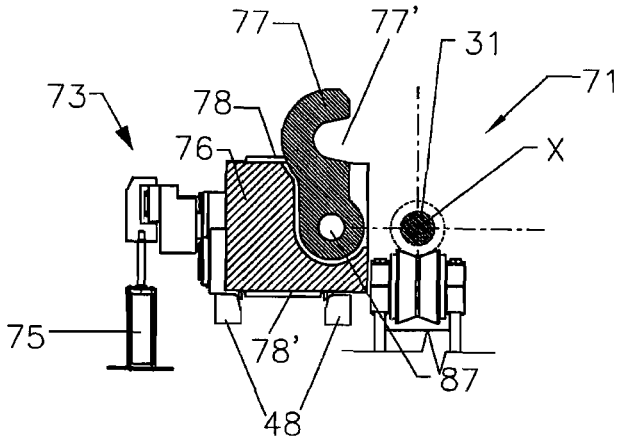
FIG. 15 shows a section view taken along plane A-A of the detail in FIG. 12 in a different operating position.
Figure 16:
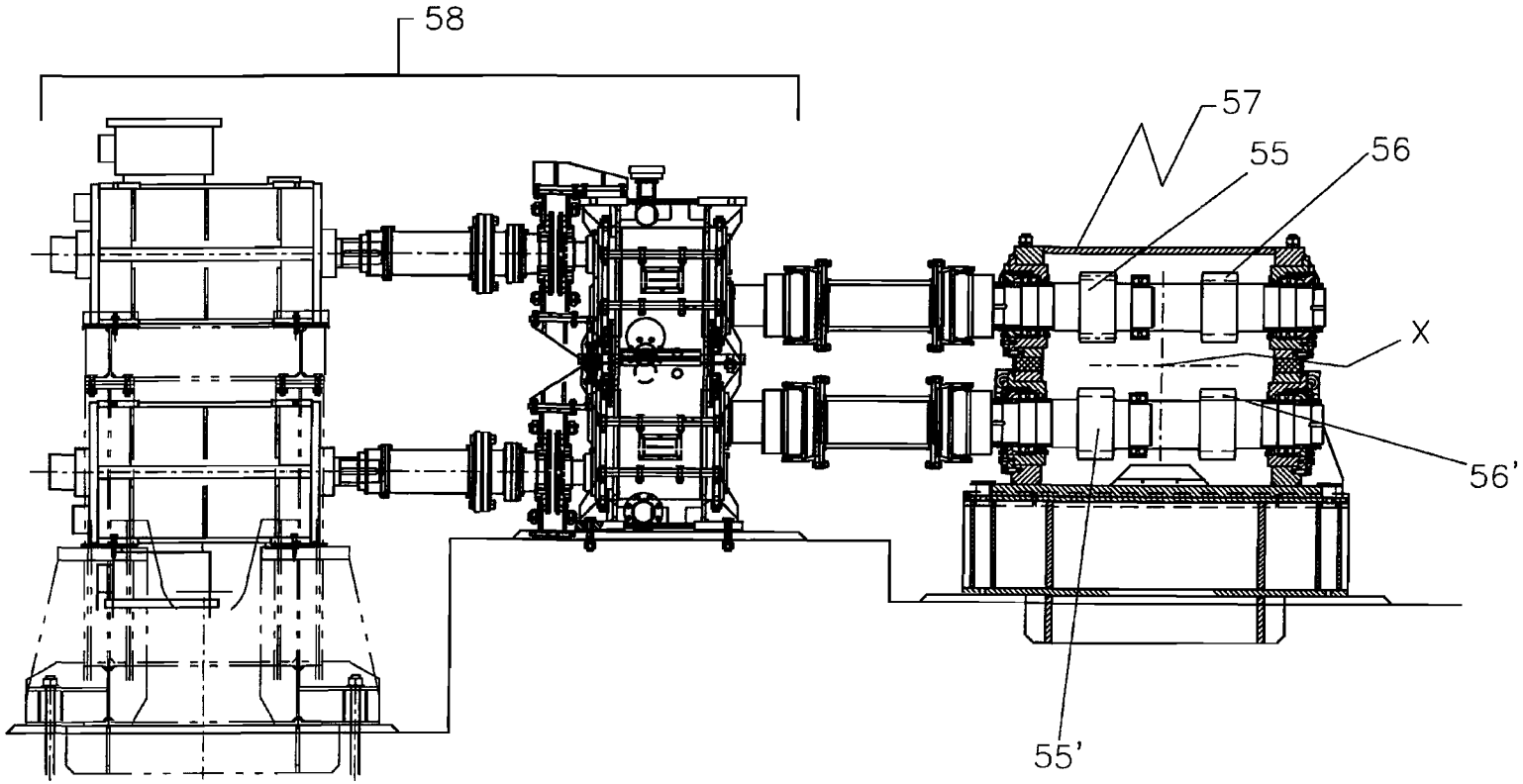
FIG. 16 shows a front view of an enlarged part of the component in FIG. 2.
Figure 17:
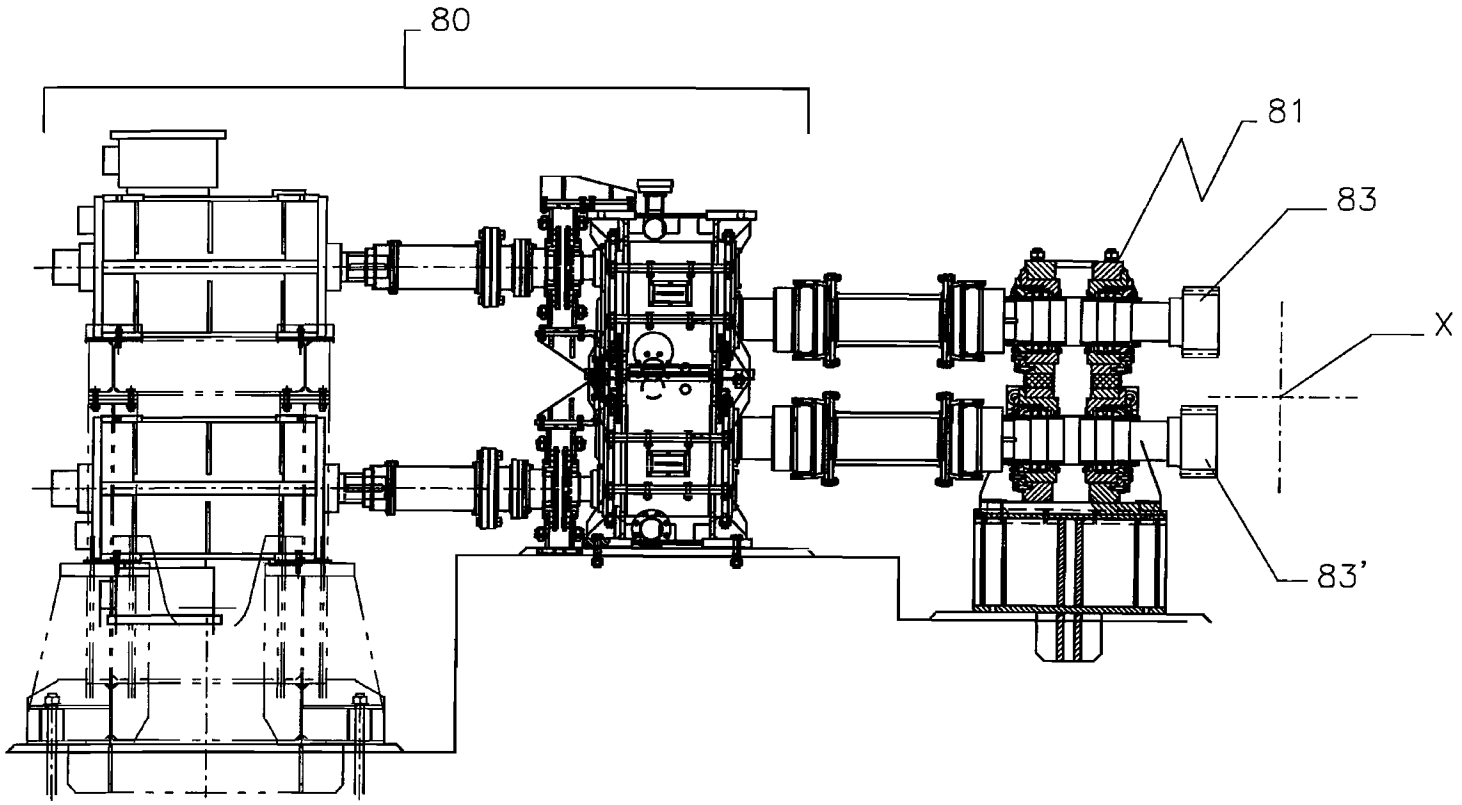
FIG. 17 shows a front view of an enlarged part of the component in FIG. 9, FIG. 18 diagrammatically shows an enlarged side view of the component in FIG. 9*a*.
Figure 18:
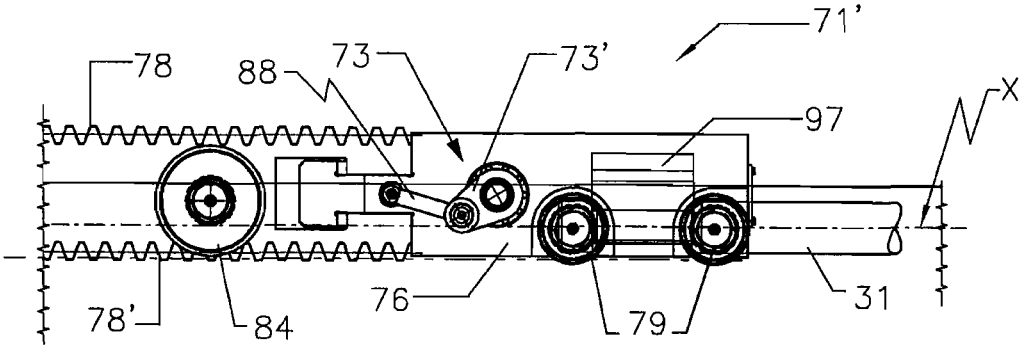
Figure 19:
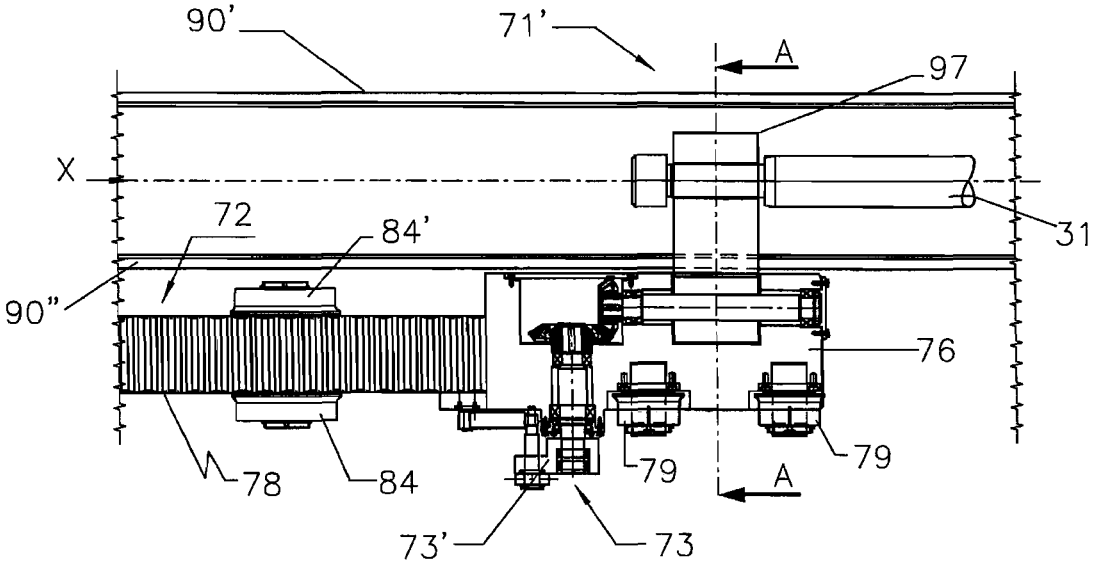
FIG. 19 shows a top view of the detail in FIG. 18.
Figure 20:
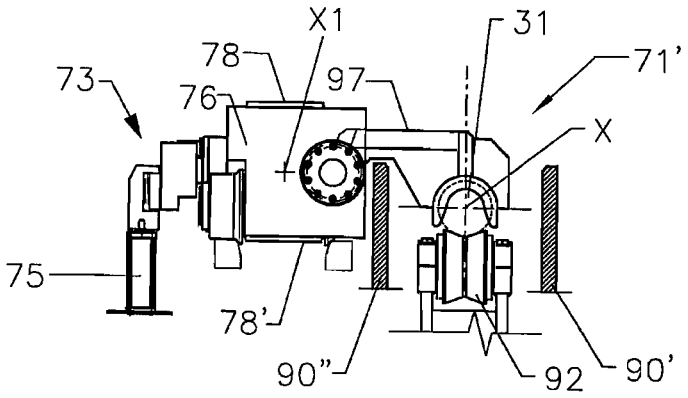
FIG. 20 shows a front view of the detail in FIG. 19.
Figure 21:
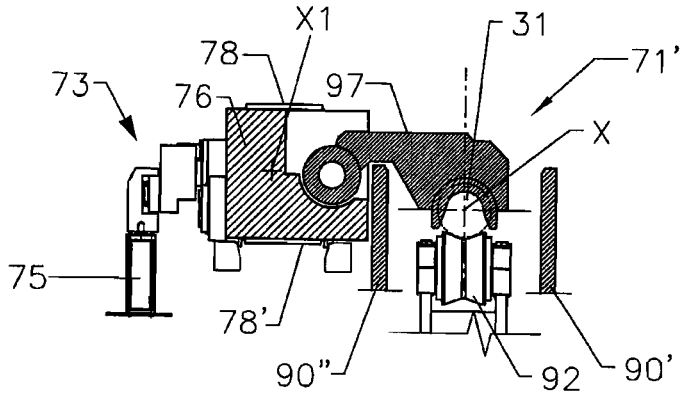
FIG. 21 shows a section view taken along plane A-A of the detail in FIG. 19.
Figure 22:
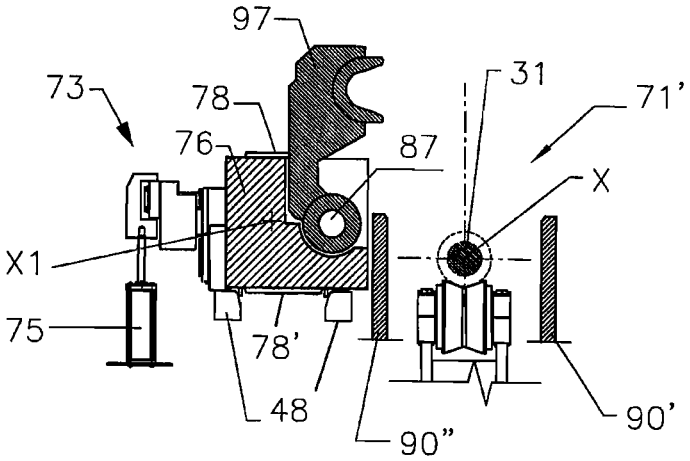
FIG. 22 shows a section view taken along plane A-A of the detail in FIG. 19 in a different operating position.

A second tang or front tang of the mandrel, arranged near the head end of the mandrel 31 itself, is engaged by means of the device 71. The hooking position of the device 71 is shown in the two FIGS. 13 and 14, while the releasing position of the mandrel of the device is shown in FIG. 15.

The device 71 also comprises a head 76 fixed to the front end of the rack 72 of the outlet side of the rolling mill, a lever 77 or drawbridge properly called, hinged to the head 76. The head 76 also includes the presence of wheels 79 running on rails 48.

The hooking and releasing device 71 is adapted to engage the mandrel only on the upper part of the tang, but not on its lower part, being the lever 77 provided with an upside-down U-shaped groove 77' complementary to the groove on the front tang of the mandrel 31. The device 71 may pass from a hooking position to a releasing position of the mandrel 31, by means of a counterclockwise rotation about the axis of the pin 87, considering the representation shown in the figures. The passage from the releasing to the hooking of the mandrel 31 occurs by clockwise rotation, instead.

Figure 2:
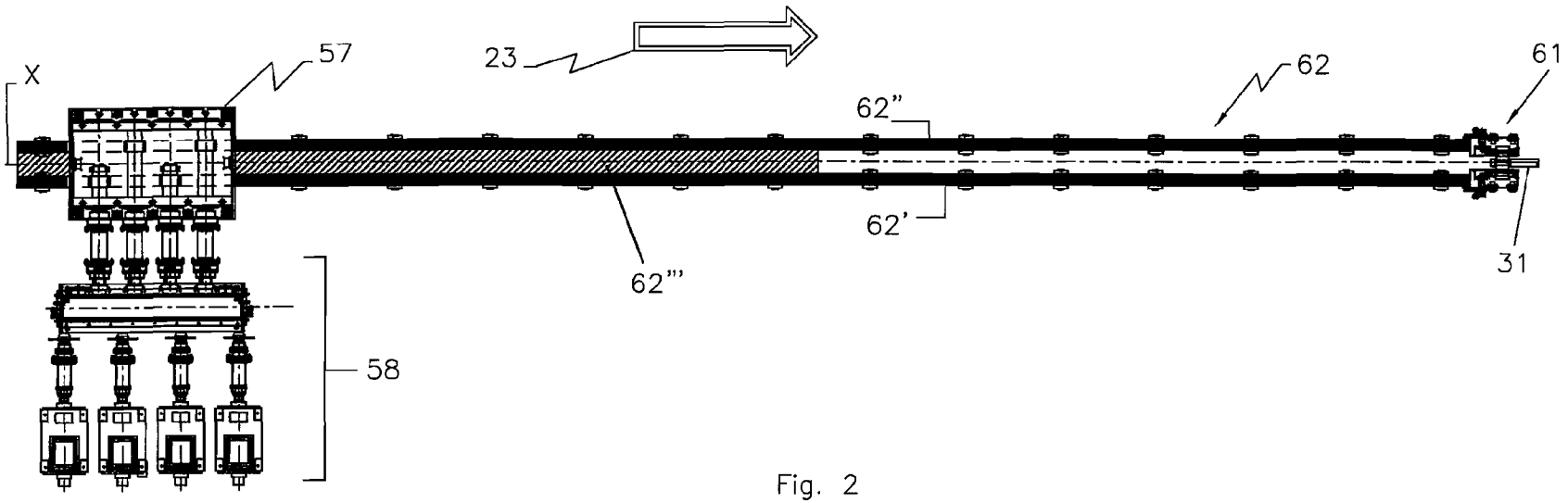
Figure 3:
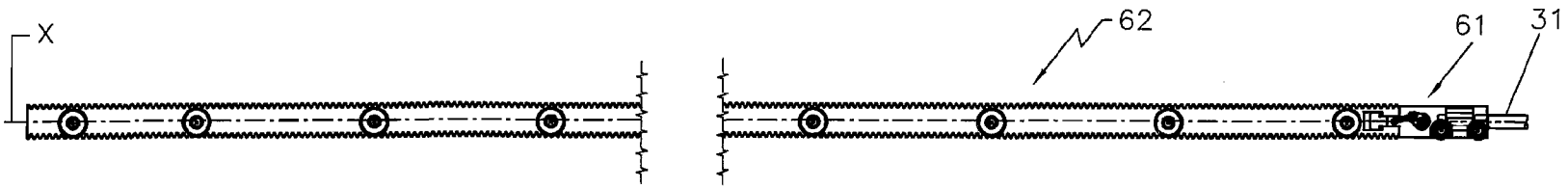
Figure 4:
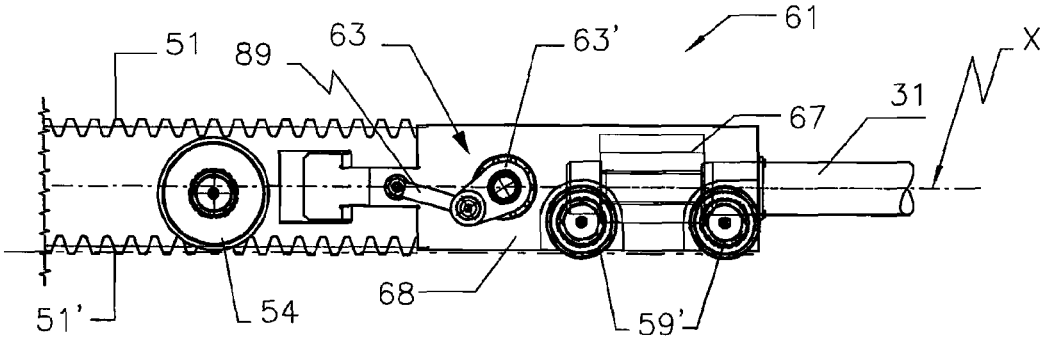
FIG. 4 shows an enlarged side view of a detail of the component in FIG. 2.
Figure 5:
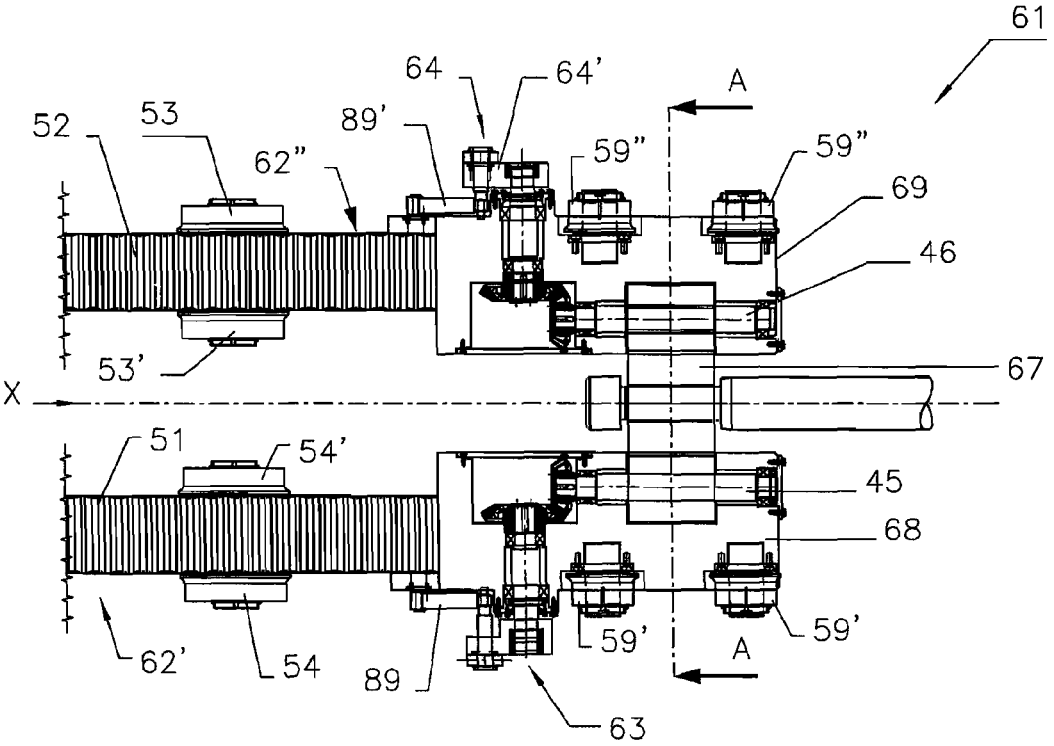
FIG. 5 shows a top view of the detail in FIG. 4.
Figure 9:
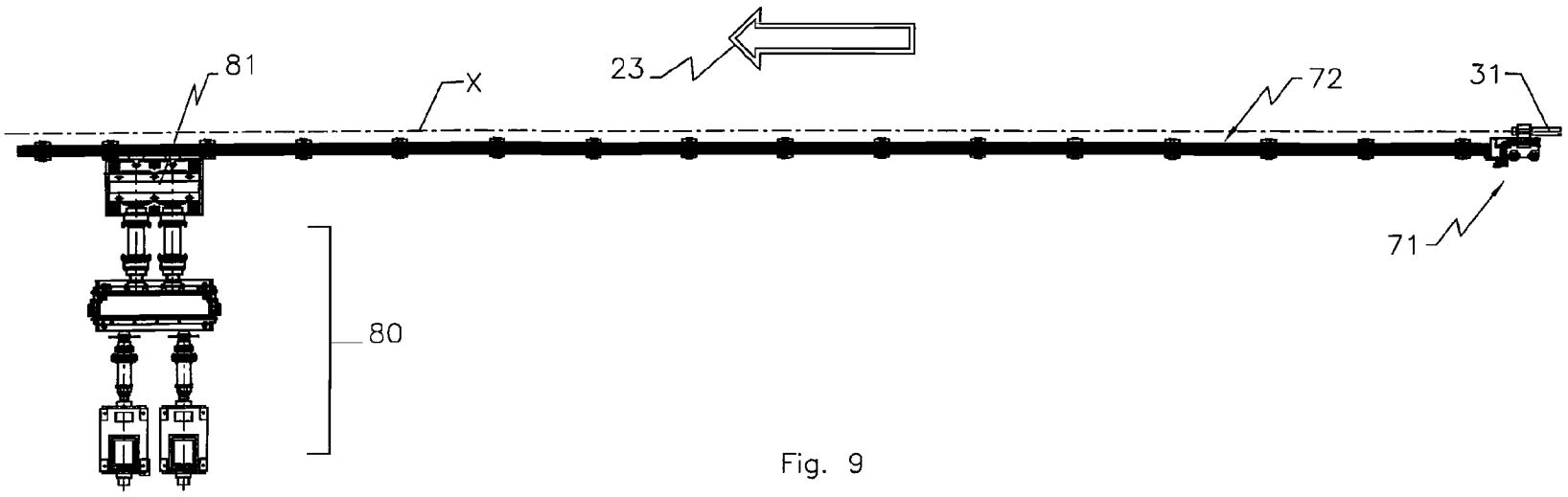
Figure 10:
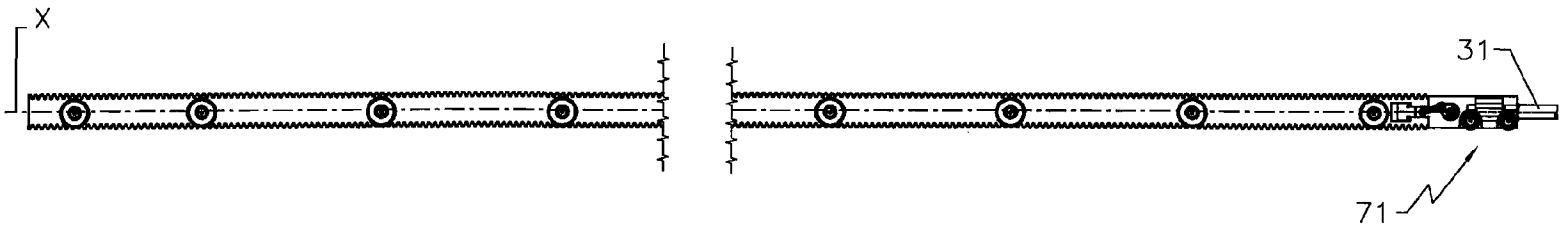

It is worth noting that the two views shown in FIGS. 9 and 10 are arranged in opposite sense with respect to FIGS. 2 and 3 of the component 62 described above, as can be inferred from the arrangement of arrow 23 indicating the direction of rolling.

It is also possible to arrange the head 76 on the opposite side with respect to the rolling axis X, and in this case the same functions are made by rotating the lever in direction opposite to that indicated above.

The device 71 also comprises an opening and closing control device 73 of the lever 77 incorporated in the head 76 integral to the rack and controlled by a moveable cam 75, or by an equivalent actuation device.

The control device 73 consists in a kinematic chain comprising a supporting pin with respective supports, a conical gear for 90° transfer of motion; a shaft and a control lever 73', preferably with wheel, a bistable system 88, preferably of the extensible rod type with spring to maintain the control lever 73' in two alternative positions corresponding to drawbridge 77 closed and drawbridge 77 open.

The moveable cam 75 is adapted to engage the control lever 73' being fixed with respect to the direction of sliding of the rack 72, and is capable of inducing an angular displacement of the respective control lever 73' in vertical direction when the hooking and releasing device 71 arrives thereat. At least two moveable cams 75 are provided in the rolling plant and fitted at the hooking and releasing points of the front tang of the mandrel 31.

Figure 9A:
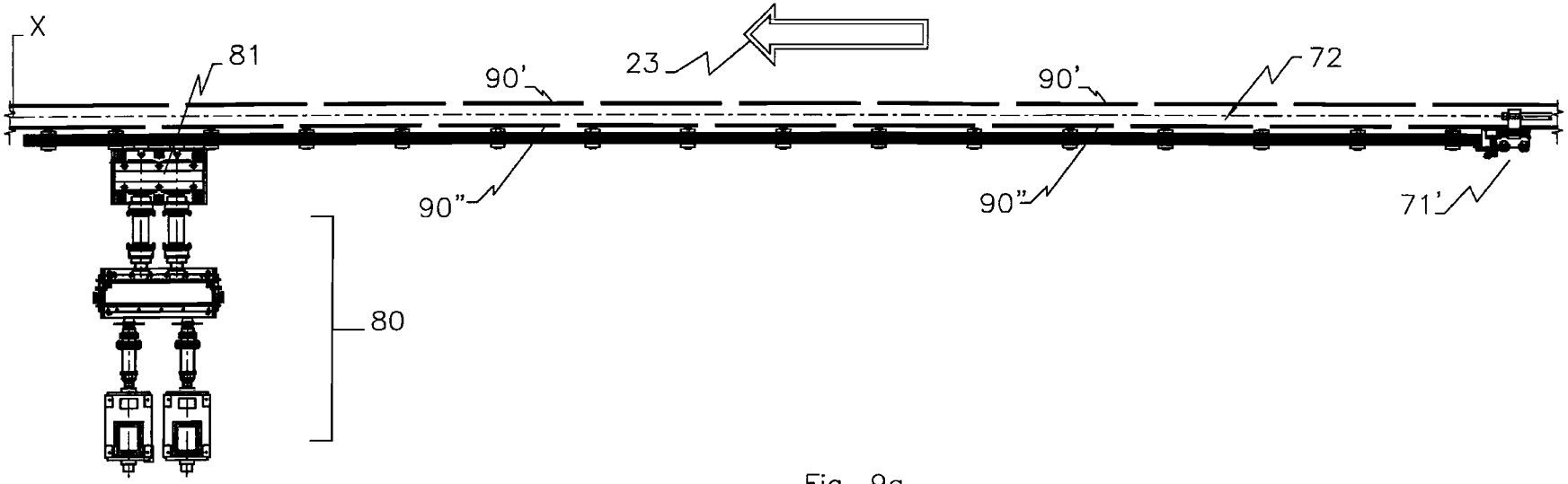
Figure 11:
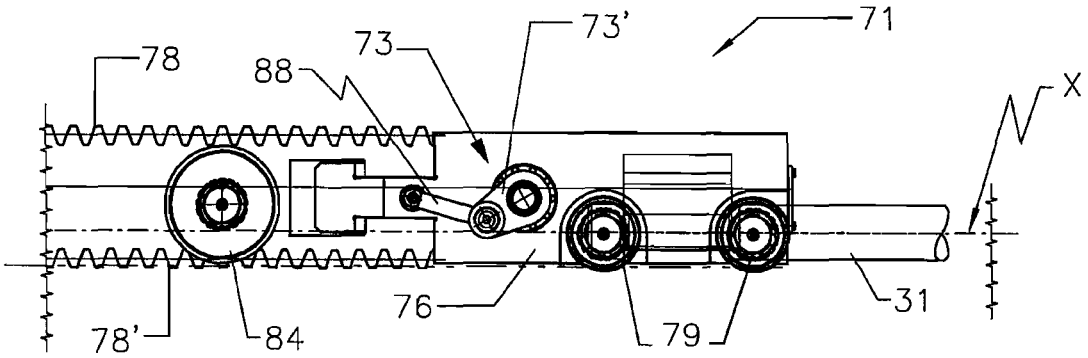
FIG. 11 shows an enlarged side view of a detail of the component in FIG. 9.
Figure 12:
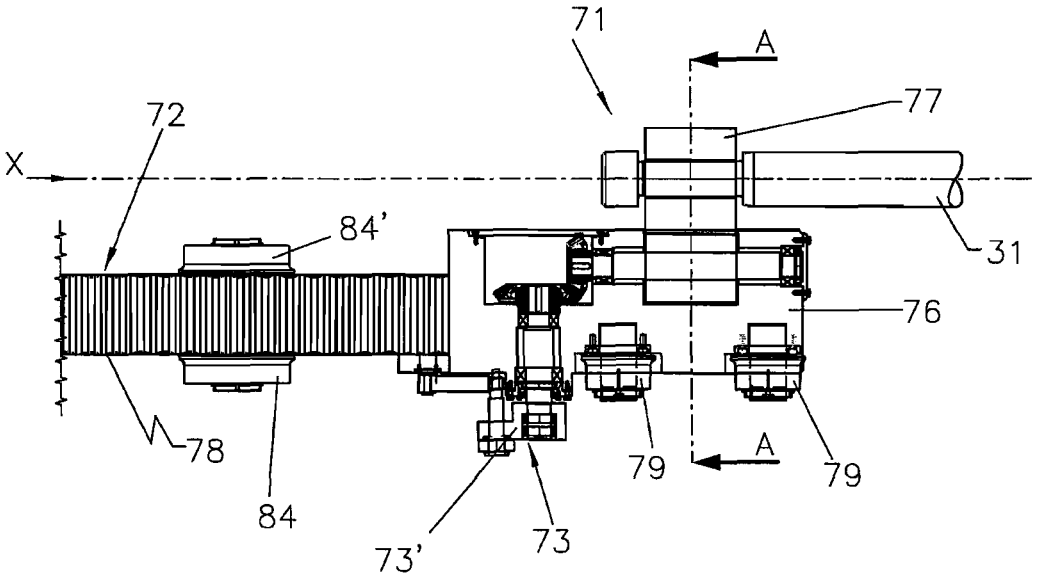
FIG. 12 shows a top view of the detail in FIG. 11.

A further variant of the mandrel conveying device 7 of the outlet area is shown in FIG. 9*a* and from 18 to 22. The same components of the variant described above are indicated with the same numerals.

In this variant, the mandrel hooking and releasing device 71, here referred to by numeral 71' and comprising a lever 97, is shaped so as to allow the presence of containment walls 90', 90" of the tube to the sides of the conveyor 7 used, when the lever is in the lowered position, to contain possible swerving of the tube transversal to the rolling axis X. The walls 90', 90" are interrupted in the sense of their length, as shown in FIG. 9*a*, to allow the passage of the tube unloading and mandrel loading devices. In this case axis X of the rack 72 may be positioned vertically in a raised position with respect to the rolling axis X.

The references to the device 71 shown below may be applied also to the variant 71'.

The speed control system of the rack 72 and of the mandrel hooking and releasing device 71 comprises a motorized pinion box 81. The pinion box 81 consists of a supporting structure of shafts provided with two toothed wheels 83, 83', which are advantageously mounted over and under the gear teeth 78, 78' of the rack 72, with which they engage to transmit the necessary forces and the motion. The drive 80 also comprises one or more reducers and a number of motors corresponding to the number of toothed wheels in the pinion box. Advantageously, the motors and the shafts exiting from the pinion box 81 are all arranged on the same side with respect to the rolling axis. The hooking and releasing devices 61 and 71, of the inlet side 20 and of the outlet side 22, incorporated in the respective conveyors 6 and 7, are controlled in reciprocally coordinated manner so that the hooking and releasing operations of the mandrel, operating in a given rolling cycle, on the head and on the tail can be carried out cyclically and rapidly at each cycle.

In the rolling mill 5 there are provided mandrel supporting stands 8, the function of which is to hold the mandrel 31 centred in order to prevent the mandrel itself from moving in direction reverse to the direction of rolling 23, through the rolling stands 12 and the possible rounding stand 10, in absence of the tube, and from knocking against the rolls causing damage to the rolls and/or to the mandrel. The mandrel supporting stands 8 are devices of the prior art consisting of adjustable rolls which may be closed to the mandrel size and opened rapidly to allow the passage of the pierced shell into the rolling stage.

The rolling plant R advantageously, but not necessarily, includes some devices which further improve the rolling process and which may be either all together present or may be inserted individually. A guillotine stop device 9, also named emergency guillotine in brief, adapted to be actuated in case of emergency for extracting the mandrel from the tube is provided on inlet side 20, along the rolling axis X. The emergency guillotine 9 comprises a retractable U-shaped resting plane, which is moveable between a not interfering position and an interfering position with the tail section of the pierced shell. Such a plane is used to contrast the motion of the pierced shell or the tube if the rolling is interrupted whilst the pierced shell or tube being rolled is still inserted on the mandrel. The emergency guillotine 9 may be positioned in various points of inlet side 20, in all cases always on the rolling axis X. A preferred solution is to arrange the emergency guillotine 9 on the inlet side 20 leaving a space between the tip of the mandrel, when it is in an all retracted position and hooked to the hooking and releasing device 61 in emergency extraction position, and the rear edge of the pierced shell when it is positioned in line in the inlet area 20.

A rounding stand 10, arranged downstream of the last rolling stand that rolls the thickness, can be provided. The purpose of the rounding stand 10 is to create an approximately uniform clearance between mandrel and inner diameter of the tube and may also be used as effective device to brake the tube in the last stage of the rolling cycle. When the tail of the rolled tube leaves the last stand which reduces the thickness, the tube itself may be braked using the rounding stand; such an operation allows to reduce the cycle times and the spaces needed to brake the tube itself at the end of rolling. Alternatively, it is also possible to provide a plurality of rounding stands 10 arranged in sequence along the rolling line X.

A feeding device 11 of the pierced shell into the rolling mill may also be provided in the rolling plant R. The feeding device 11, shown for the sake of simplicity only in FIG. 1, preferably comprises one or more series of counterpoised rolls, of which at least one is motorized, which move from a diametrical position with respect to pierced shell out from any interference to one position in contact with the pierced shell, after the pierced shell has been loaded onto the rolling axis X. Such a feeding device 11 allows to feed the pierced shell into the multi-stand rolling mill 5 in controlled speed and position conditions.

Furthermore, the feeding device 11 may be advantageously, but not necessarily, used to hold the pierced shell in position during the step of backward insertion of the mandrel into the same.

The rolling plant R according to the invention described above may implement a particularly advantageous high production tube rolling process in an optimal way. The stages of a rolling process of this type are described in detail below. Conventionally, unless otherwise specified, the "front" and "rear" indication of the various elements are referred to the direction of rolling 23, i.e. front refers to the tip of the arrow 23, rear is referred to the tail of the arrow 23.

In FIG. 1 the rolling plant R is shown with its components positioned at a specific rolling stage of a tube in any rolling process cycle. In order to generalise the description, "n" will indicate the described cycle, where "n" is the ordinal number referred to a generic full-rate rolling cycle.

At the beginning of cycle "n" the mandrel 31 is positioned laterally to the rolling line X at the outlet side 22 ready to be inserted on the rolling line X by actuating the rotating arm in the side direction. The hooking device 71 of the mandrel on the outlet side 22 is arranged along the rolling line at the height of the head of the mandrel 31 in the hooking position P1.

A pierced shell 39 is arranged on the rolling line X with the front tip of the pierced shell 39 at the feeding device 11, by actuating the rotating arm with a translation that is transversal with respect to the axis X.

The hooking device 61 is moved towards the rear end of the pierced shell 39 in direction of the arrow 23 to assume the hooking position of the mandrel 31. At the same time and in coordinated manner, the operations are also carried out on the outlet side 22 whereby the mandrel 31 is loaded along the rolling axis X with a rotation of the rotating arm and the front tang of the mandrel 31 is gripped by the hooking device 71, which starts a translation motion integrally pushing the mandrel in direction contrary to the rolling direction 23.

Subsequently the mandrel 31, pushed by the hooking device 71, is passed backwards, in sense opposite to the rolling direction, firstly inside the multi-stand rolling mill 5, guided in such an operation by the mandrel support stands 8 and subsequently also inside the axial hole of the pierced shell 39 until the rear area of the mandrel 31 exits from the rear end of the pierced shell 39 and is positioned at the hooking device 61. When the mandrel 31 has reached this position, the hooking device 71 unhooks the front tang of the mandrel 31. At the same time, in coordinated manner, the hooking device 61 grips the rear tang of the mandrel 31. The pierced shell 39 is thus gripped by the front end thereof by means of the feeding device 11 which drags it inside the multi-stand rolling mill 5 to carry out the rolling stage shown in FIG. 1.

The rolling of the pierced shell 39 inside the multi-stand rolling mill 5 occurs with the mandrel 31 dragged by the hooking device 61 and in motion in direction of the arrow L3, opposite and retrograde with respect to the arrow 23. The motion of the mandrel 31 is coordinated to the motion of the tube 42, indicated by the arrow L4, generated by the rolls of the rolling stands 12 of the rolling mill 5. The motion speed of the mandrel 31 in the direction of the arrow L3 is designed so that the front end of the mandrel 31 is at the rear end of the tube 42, completely rolled, when the rear end of the tube exits from the last rolling stand, i.e. the one most on the right of the stands indicated by reference numeral 12 in FIG. 1, defining the "meeting point" there. In this manner, the mandrel 31 is completely extracted from the cavity of the tube 42 completely rolled after passing the meeting point.

The hooking device 71, now unhooked from the mandrel 31, has in the meantime moved with the motion indicated by the arrow L5, agreeing with the rolling direction 23, up to the hooking position P1, where another mandrel (not shown) to be used in the subsequent rolling cycle "n+1" is hooked.

As shown in FIG. 1 the tube 42, in addition to being rolled by means of the rolls of the rolling stands 12, may be passed through one or more rounding stands 10. This operation is optional and contributes to improving the shape of the finished tube.

During this last step of rolling, the mandrel 31 which has left the inside of the tube 42 is braked to arrange it on the rolling axis X in a position so that is clear from the multi-standard rolling mill 5, in order to be evacuated from the rolling line in side direction, with a rotation of the rotating arm, before starting the subsequent rolling cycle "n+1".

In coordinated manner, the rear tang of the mandrel 31 is released from the engagement of the hooking device 61, when it is in releasing position P3, to allow the evacuation of the rolling axis X by means of a rotation of the rotating arm in side direction.

The rolling cycle "n+1" of the subsequent pierced shell may thus start with the same operations of the previous cycle "n" described above and using the next mandrel.

What is claimed is:

1. A mandrel conveying device for a multi-stand tube rolling mill with mandrel, defining a rolling axis, the conveying device comprising a rack device and a hooking and releasing device, for hooking and for releasing a tang of the mandrel, the hooking and releasing device comprising at least a head and a lever hinged to said head, wherein said lever being adapted to move with an angular oscillation between a hooking position and a releasing position of the tang of the mandrel, wherein the lever engages a locking pin of another head on an opposite side of the rolling axis when in the hooking position, said angular oscillation being performed on a plane transversal to the rolling axis, said lever being shaped in a part with a groove complementary with the shape of said tang of the mandrel, said lever acting in connection of said tang of said mandrel in said hooking position, wherein the rack device comprises two racks side-by-side and parallel to the rolling axis, each of said two racks has two respective gear teeth, the hooking and releasing device being arranged at one end of the two racks.

2. A device according to claim 1, wherein the hooking and releasing device comprises two heads, each head being arranged at one end of one respective rack.

3. A device according to claim 2, wherein the two racks are joined along part of their length by a joining element.

4. A device according to claim 3, wherein the two respective gear teeth of each rack are arranged symmetrically one above and one below the rolling axis.

5. A device according to claim 1, comprising a cam device and wherein the hooking and releasing device comprises a mechanism actuated by the cam device.

6. A device according to claim 5, wherein the hooking and releasing device comprises a blocking device for blocking the lever in hooking position of the mandrel.

7. A rolling plant for tubes having defined length, comprising:

a rolling mill, defining a rolling axis, incorporating a plurality of rolling stands adapted to carry out a rolling of a pierced shell to transform it into a rolled tube, at least one mandrel, having a front end and a rear end, adapted to cooperate with the rolling mill during said rolling, the rolling plant comprising the following, upstream of the rolling mill:

a first loading device for loading the pierced shell along the rolling axis, a first unloading device for unloading the at least one mandrel from the rolling axis, a first mandrel conveying device according to claim 1, the rolling plant comprising the following, downstream of the rolling mill:

a second unloading device adapted to unload the rolled tube from the rolling axis, a second loading device adapted to load the at least one mandrel along the rolling axis, a second mandrel conveying device, comprising a second hooking and releasing device for hooking and for releasing the front end of the at least one mandrel.

8. A rolling plant according to claim 7, wherein control means of the rolling plant are provided to coordinate the first conveying device and the second conveying device in their hooking and releasing operations of the front and rear ends of the at least one mandrel at each rolling cycle.

9. A rolling plant according to claim 8, wherein the front end and the rear end of the at least one mandrel are equipped with a front tang and a rear tang, respectively, for carrying out the hooking and releasing operations by means of the first conveying device and the second conveying device.

10. A rolling plant according to claim 9, wherein said rolling mill comprises mandrel-supporting stands.

11. A rolling plant according to claim 10, wherein a feeding device of the pierced shell is provided in the rolling mill.

12. A rolling plant according to claim 11, wherein there is provided at least one rounding stand which is arranged downstream of the last rolling stand of a rolling mill.

* * * * *